United States Patent [19]

Rubaschek et al.

[11] 4,034,446

[45] July 12, 1977

[54] DOUBLE-TIERED SWIRLING MACHINE FOR PILE FABRIC

[75] Inventors: Nathan Rubaschek, Brooklyn; Henry Rubinstein, Sunnyside, both of N.Y.

[73] Assignees: Paris Processing Corporation; New York Blending Corporation, both of New York, N.Y.

[21] Appl. No.: 661,105

[22] Filed: Feb. 25, 1976

[51] Int. Cl.[2] ..... D06C 23/02

[52] U.S. Cl. ..... 26/2 R; 26/27

[58] Field of Search ..... 26/2 R, 27, 30, 69 R

[56] References Cited

U.S. PATENT DOCUMENTS

| | | | |
|---|---|---|---|
| 2,163,674 | 6/1939 | Gentle | 26/2 R |
| 3,256,581 | 6/1966 | Thal et al. | 26/2 R |
| 3,774,272 | 11/1973 | Rubaschek et al. | 26/2 R |
| 3,785,016 | 1/1974 | Hergert | 26/2 R |

FOREIGN PATENT DOCUMENTS

| | | | |
|---|---|---|---|
| 2,164,900 | 7/1973 | Germany | 26/2 R |
| 699,386 | 12/1965 | Italy | 26/2 R |
| 728,593 | 12/1966 | Italy | 26/2 R |
| 2,871 | 1888 | United Kingdom | 26/2 R |

OTHER PUBLICATIONS

PW-180 POL-WHIRL, Bulletin by Polrotor, Inc., U.S.A., 60 Seabro Ave., Amityville, N.Y. 11701.

*Primary Examiner*—Robert R. Mackey
*Attorney, Agent, or Firm*—Gottlieb, Rackman & Reisman

[57] ABSTRACT

A device for forming surface designs on pile fabric is disclosed, in which a plurality of conical brushes are utilized to swirl the fibers of the fabric. The device is provided with two tiers of rotatable brushes, and the fabric passes beneath both tiers of brushes. The brushes of one tier constantly rotate in contact with the surface of the fabric, while the brushes of the other tier also rotate, but are normally suspended above the fabric. Control means is provided to selectively move individual brushes in the second tier downward, and into momentary contact with the pile fabric passing beneath. Shifting means are provided to selectively move both tiers of brushes as a unit across the width of the fabric.

8 Claims, 7 Drawing Figures

DOUBLE-TIERED SWIRLING MACHINE FOR PILE FABRIC

This invention relates to machines for operating on textile fabrics, and more specifically, to an apparatus for treatment of pile fabric in order to create surface designs thereon.

As a result of the recent emphasis upon conservation and the preservation of natural wildlife, the textile industry has developed pile fabrics which resemble the skins of animals in both texture and appearance. Such pile fabrics, which are known generally in the trade as artificial furs, are then cut into garments such as coats or jackets, and are sold to the public.

It is often desirable to enhance the appearance of artificial fur fabrics by treating them in some manner so as to create special effects. For example, in Mazzone et al. U.S. Pat. No. 3,613,186, an apparatus for selectively directing jets of hot air towards a pile fabric in order to produce a sculptured effect is disclosed. Various patterns can be created by varying the orientation and/or the flow rate of particular jets.

Another device for treating pile fabrics is described in Gentle U.S. Pat. No. 2,163,674, where the desired decorative effect is produced by swirling the fabric in such a way as to create a striped effect. This is accomplished by feeding the fabric through a swirling machine having several adjacent conical brushes mounted on shafts and suspended in a row or tier immediately above and across the width of the fabric. The brushes are in constant contact with the fabric and are rotated at high speed while the fabric is transported beneath them, thereby imparting a slight curl to the individual fibers of the fabric. Each brush rotates in a direction which is opposite to that of its adjacent brush, so that the fibers of adjoining longitudinal portions of the pile point in different directions, thereby creating a striped effect. In addition, such machines often contain means for shifting the entire tier of brushes back and forth as a unit across the width of the fabric at specified time intervals, when desired. Thus, depending upon the frequency with which the tier of brushes is shifted, the striped effect can be made to appear either undulatory or crenelated.

Although the designs provided by the prior art have been somewhat satisfactory, the final patterns achieved by using these machines do not provide sufficiently realistic imitations of the furs of real animals.

An additional decorative effect which also provides a very realistic fur pattern can be achieved if, in conjunction with the pattern described above, the fabric is also subjected according to the present invention to random supplementary spot swirling, which, at any given point, either reinforces or counteracts the swirl which has already been imparted to the fabric. The above prior art is not capable of creating such specialized patterns, which are useful in creating fabrics which imitate the furs of a wide variety of animals.

It is therefore an object of this invention to provide an apparatus for imparting improved designs to artificial fur fabrics which can create a striped decorative effect.

Another object of this invention is to provide an apparatus for imparting improved striped designs to artificial fur fabrics with which, at the option of the apparatus operator, the stripes can be made to appear either undulatory or crenelated.

It is a further object of this invention to provide an apparatus for imparting improved striped designs to artificial fur fabrics which, at the option of the apparatus operator, can create the striped pattern either alone or in combination with a random pattern of spots superimposed upon the stripes.

It is a still further object of this invention to provide an apparatus for imparting improved designs to artificial fur fabrics which is simple in operation, economical in cost, and relatively easy to use.

Briefly, in accordance with the principles of this invention, a swirling machine is provided with two tiers of rotatable brushes. The tiers are suspended above a platform across which artificial fur fabric is transported. The brushes of the first tier rotate rapidly and are suspended at a height at which the faces of the brushes are maintained in constant contact with the pile fabric. The brushes of the second tier, although constantly rotating like those of the first tier, do not constantly contact the fabric. Each brush of the second tier is mounted on its own shaft above the fabric platform. Each such shaft is reciprocated toward and away from the fabric by control means. The control means includes circuit means which selectively activates any one brush of the tier independently of the other brushes in the second tier. Activation moves the selected brush downwardly so as to come into contact with and swirl the fabric for a short predetermined, programmed period of time. Each brush in the second tier may be activated at different times, or not at all, thus creating a desired "random" pattern.

Further objects, features and advantages of this invention will become more readily apparent from an examination of the following specification, when taken in conjunction with the accompanying drawings, wherein.

Figure 1:
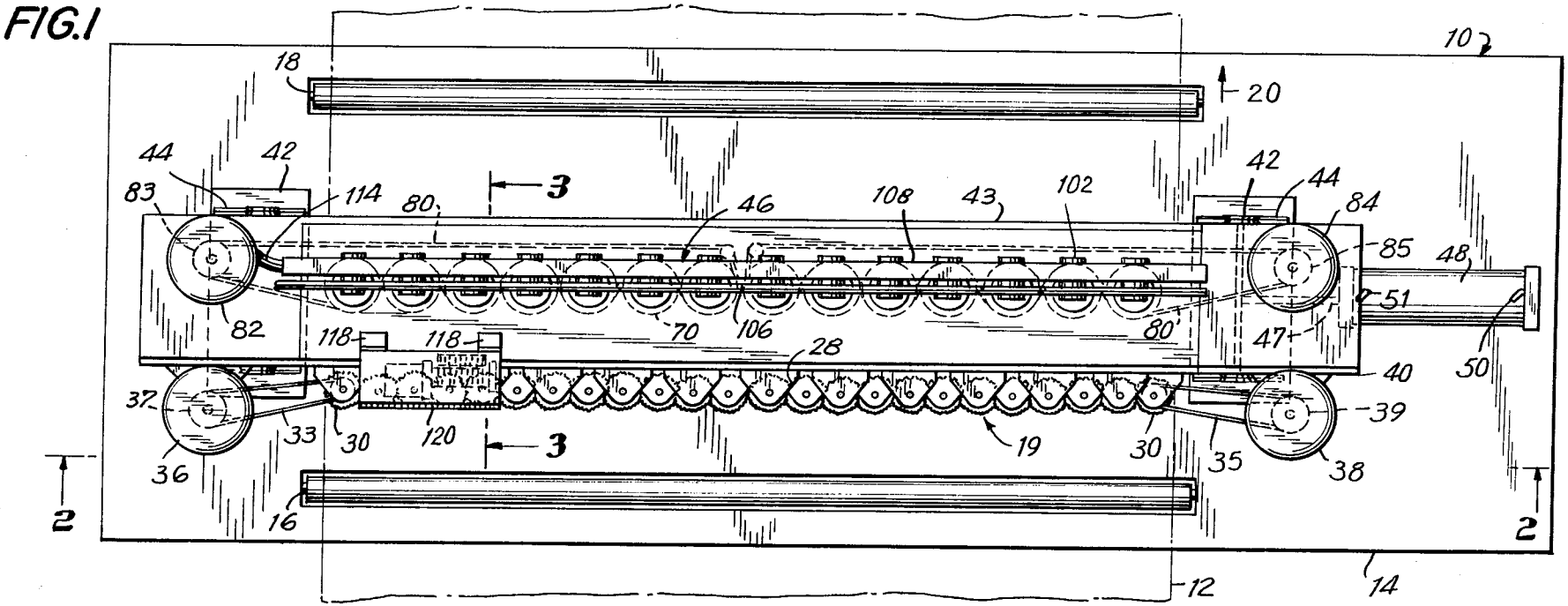
FIG. 1 is a top plan view of a double-tiered swirling machine constructed in accordance with the principles of the present invention.

Referring now to the drawings, and specifically to FIG. 1, a double-tiered swirling machine embodying the principles of the present invention is generally designated 10. A bolt of artificial fur fabric 12 is transported across a platform 14 from roller 16 toward roller 18 in the direction of arrow 20. The fabric is transported by the leading end thereof being engaged by a wind-up roller in a conventional manner (not shown).

Figure 2:
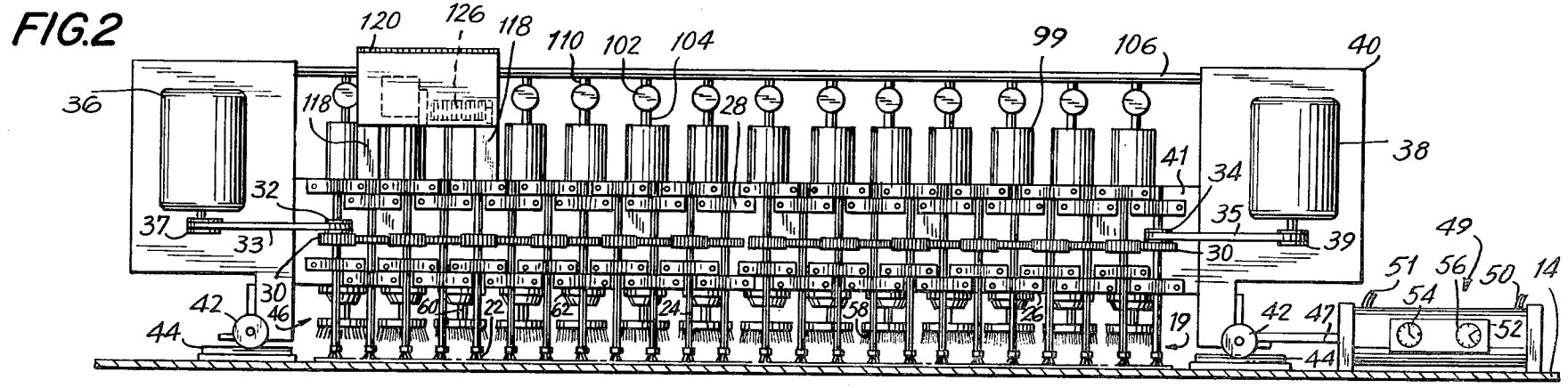
FIG. 2 is a transverse cross-sectional view, taken substantially along line 2—2 of FIG. 1.
Figure 3:
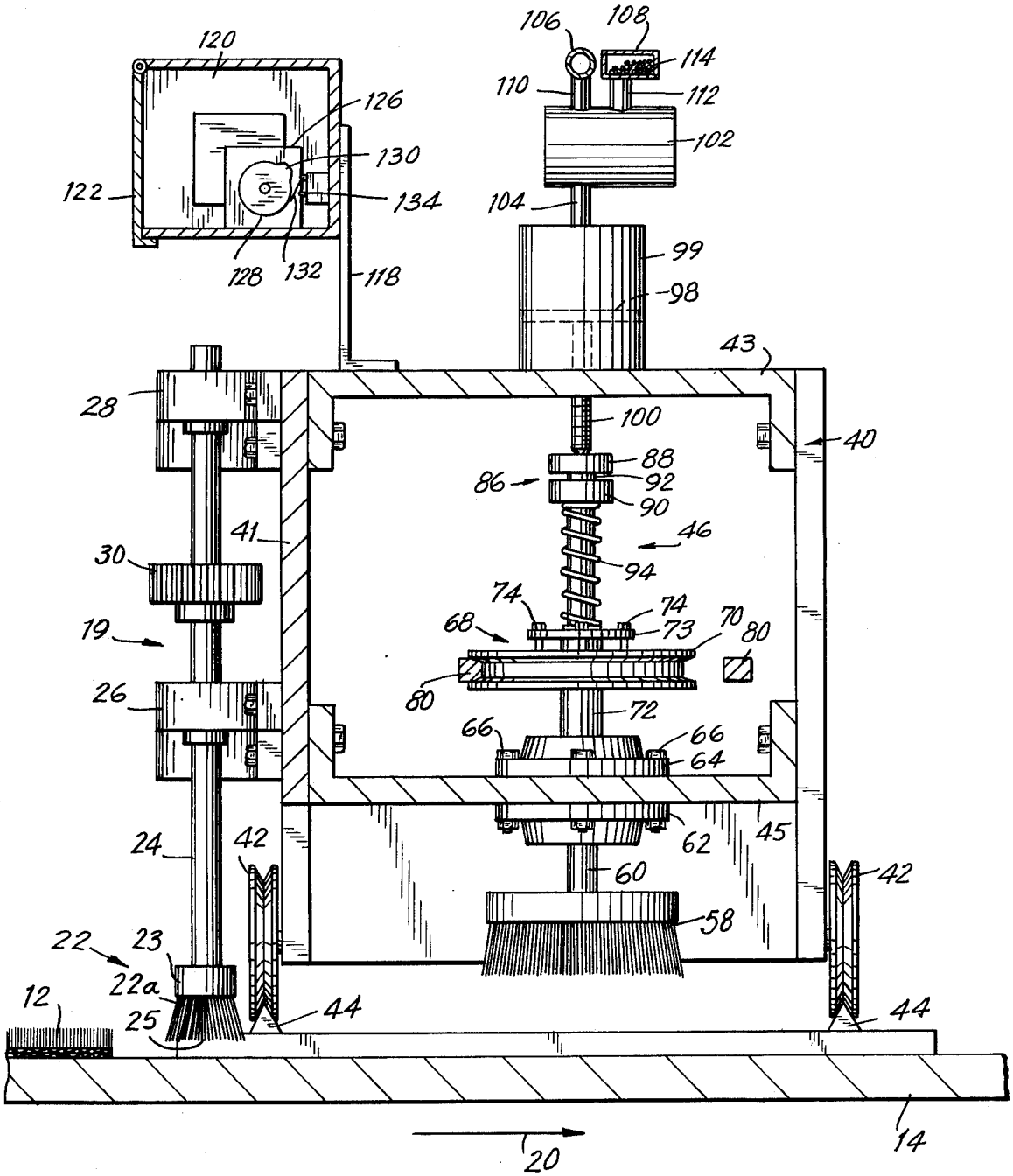
FIG. 3 is an enlarged cross-sectional side view taken substantially along line 3—3 of FIG. 1.

Referring now, in addition, to FIGS. 2 and 3, a first tier of brushes 19 includes a substantial number, for example 24, of brushes 22. All of the brushes of the first tier 19 are substantially identical, the brush 22 and its associated parts shown in FIG. 3 being typical. Each brush 22 comprises a plurality of metal bristles **22*a* forming a frusto-conical shape held by a cap 23, and having a lower flat face 25. Each brush 22 is removably attached by conventional means to a spindle 24, which is journaled in bearings in spaced brace members 26, 28. Brushes of varying sizes, configurations, and stiffnesses may be substituted at the option of the operator. Each spindle 24 carries a gear 30, with all of the gears 30** of the various spindles meshing in series.

Drive means is provided to drive all of the spindles 24 and thereby the brushes 22. Such drive means includes a pair of motors 36, 38, disposed at opposite sides of machine 10 and having drive shafts carrying pulleys 37, 39, respectively. The respective pulleys are linked by drive belts 33 or 35 to pulleys 32 or 34 mounted on the endmost spindles 24 of the first tier 19 of brushes 22. When the motors are activated, the spindles are rotated by the pulleys and belts just described. Each spindle 24 rotates in a direction contrary to that of its neighbor. This arrangement of parts permits the rotational motion of the drive shafts of motors 36, 38, to be transmitted to the entire first tier 19 of brushes 22.

The apparatus 10 also includes a movable frame 40 having an upstanding side-wall 41, an upper cross-piece 43, and a lower cross-piece 45 (see FIG. 3). Brace members 26, 28, which support the spindles 24 of the first tier 19, are attached to wall 41. As shown best in FIG. 3, frame 40 is carried on grooved wheels 42 which ride on parallel raised track segments 44. Frame 40 is reciprocally driven transverse to the direction of arrow 20 along track segments 44 by reciprocating means, generally designated 49, which includes an air-driven piston (not shown) slidably mounted within a chamber 48. The connecting rod 47 of the piston is attached to a portion of the frame 40, as shown in FIG. 2.

A source of compressed air (not shown) is connected to chamber 48 by hoses 50, 51. Electric timing means 52 of any suitable type is mounted on chamber 48 and controls the reciprocal motion of the piston within chamber 48, and thus the reciprocal motion of frame 40 along track segments 44. In the preferred embodiment, timing means 52 contains two timers 54, 56. Timers 54, 56 each may be programmed by means of an indicator hand to define any desired interval of time during which frame 40 is held at one of its two extreme positions. Thus, the entire first tier 19 of brushes 22, as well as the second tier 46 of brushes 58, described hereafter, is shifted as a unit across the width of fabric 12 by means of the movement of frame 40 along track segments 44.

Figure 4:
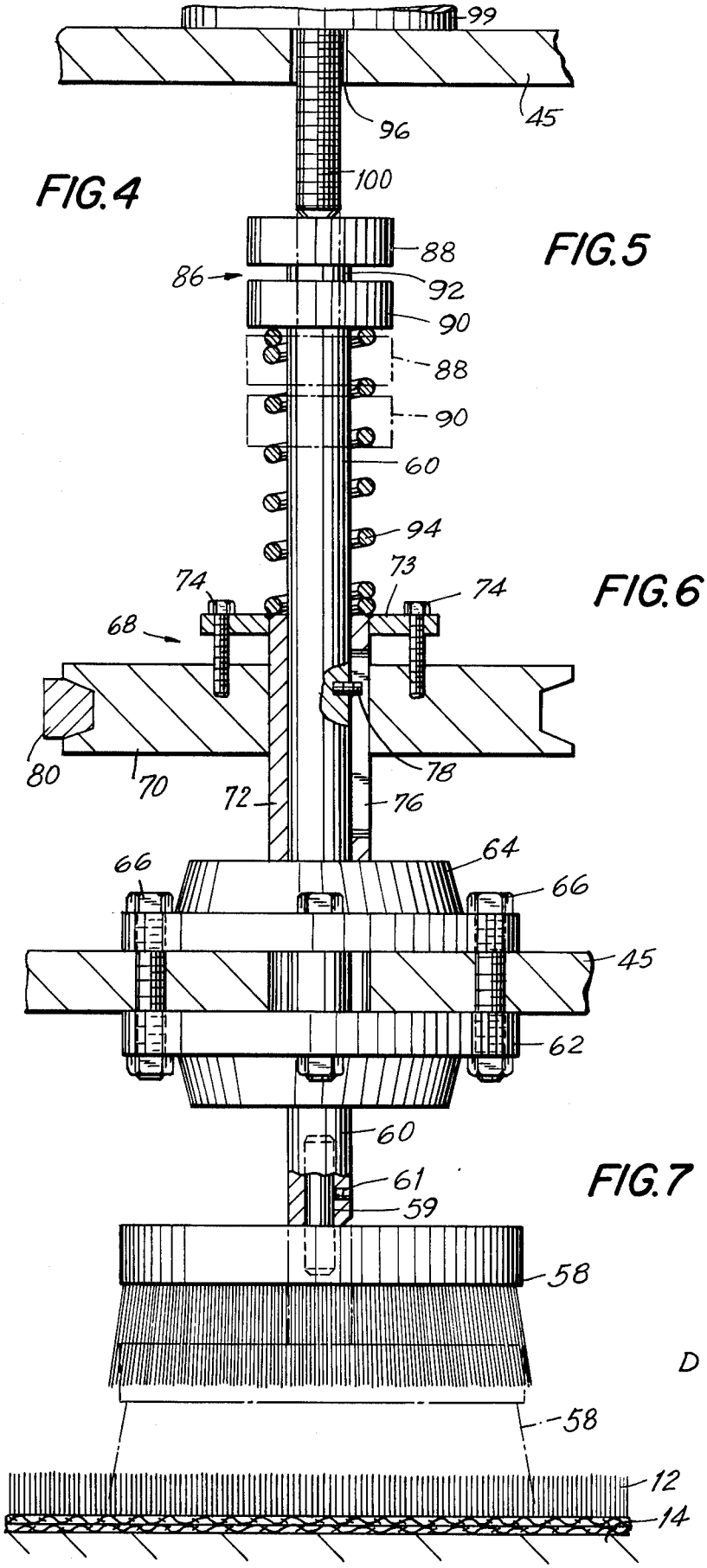
FIG. 4 is a further enlarged partial cross-sectional view of one of the brushes of the second tier of brushes.

Referring now, in addition, to FIG. 4, a second tier of brushes 46 includes a substantial number, for example sixteen, of brushes 58. The second tier of brushes 46 is disposed "downstream" of the first tier 19, such that fabric 12 passes beneath first tier 19 before passing beneath second tier 46. All of the brushes of second tier 46 are substantially identical, the brush 58 and its associated parts shown in FIGS. 3 and 4 being typical. Each brush 58 is detachably secured to spindle 60 by conventional attaching means. Such attaching means includes a rod 59 received in a cavity in the lower end of spindle 60 and secured by set screw 61. Spindle 60 is journaled for axial and reciprocal motion in bearings 62, 64 which are secured to lower cross-piece 45 of frame 40 by means of bolts 66.

Drive means for driving the brushes of the second tier 46 includes a series of pulley assemblies 68. Each pulley assembly 68 includes a pulley 70 disposed about a casing 72, and an annular bearing plate 73. As can be seen most clearly in FIG. 4, plate 73 is bolted to pulley 70 by means of bolts 74 and is welded to the upper end of casing 72. This enables the pulley, when rotated, to impart rotational motion to casing 72.

Interlocking means is provided for joining spindle 60 to pulley assembly 68, while permitting spindle 60 to reciprocate axially. Said means includes an axially elongated key groove 76 in casing 72 which accepts and guides a pin 78 protruding from spindle 60. Thus, when pulley 70 rotates casing 72, the rotational movement is transmitted to spindle 60 which, in turn, rotates brush 58.

As shown in FIG. 1, the aforesaid drive means for driving the brushes of the second tier 46 further includes motors 82, 84, having drive shafts carrying respective pulleys 83, 85. Each pulley is linked to one-half of the spindles 60 by one of a pair of drive belts 80. When motors 82, 84 are activated, rotational motion will be imparted by belt 80, in turn, to pulley 70, plate 73, casing 72, pin 78, spindle 60, and thereby to brush 58. Belts 80 snake about the pulleys 70 through a path as shown in FIG. 1 so that each spindle 60 rotates in a direction contrary to that of its neighbor.

As shown best in FIG. 4, the other end of spindle 60 has a top bearing 86 comprised of an upper disc 88, a lower disc 90, and a neck 92 of reduced diameter. Lower disc 90 is fixed to spindle 60 and rotates with it. Neck 92 is rotatably mounted internally of lower disc 90 by means of a bearing (not shown). Upper disc 88 is fixed to neck 92, so that upper disc 88 and neck 92 rotate as a unit.

Referring particularly to FIGS. 3 and 4, control means for axially driving the spindles 60 of the second tier 46 of brushes 58 toward the fabric includes an air-driven piston 98 slidably disposed within a cylinder 99. The connecting rod 100 of the piston 98, which protrudes through an aperture 96, located in upper cross-piece 43 of frame 40, is in axial alignment with spindle 60 and contacts top bearing 86 of spindle 60. The aforesaid control means further includes an air valve 102 of conventional construction fixed to cylinder 99 by intermediate connecting member 104. A source of compressed air (not shown) is connected to valve 102 by hose 106 and connecting member 110. The aforesaid control means further includes a solenoid (not shown), and circuit means for selective activation of the control means. Conduit 108, which is attached to valve 102 by connecting member 112, contains wires 114 which provide the necessary electrical connection between the solenoid and said circuit means.

The aforesaid circuit means includes a housing 120 supported by braces 118 and having a hinged cover 122, and a drum programmer or multiple circuit program timer 126 of standard construction, many types and styles of which are commercially available. Timer 126 comprises a rotatable cylinder 128 having a multiplicity of manually operable cams 130 disposed thereon, and a series of arms 132 and contact elements 134. Arm 132 is normally spaced from contact element 134 and is disposed so as to engage the cams 130 on cylinder 128. One arm and one contact element is provided for activation of a solenoid for each brush in second tier 46. As cylinder 128 rotates, cam 130 engages arm 132 and moves it into contact with contact element 134, thereby closing a circuit which activates the associated solenoid. The operator of apparatus 10 can therefore set the cams 130 in any desired manner so that via the circuit means the various solenoids are operated at desired points in time.

Spindle 60 and brush 58 reciprocate between a raised or inoperative position, shown in solid lines in FIG. 4, and a lowered or operative position, as shown by the phantom lines in FIG. 4. In the operative position, the faces of brushes 58 swirl the fabric 12. Biasing means to bias spindles 60 to their raised positions comprise, for each spindle, a coiled expansion spring 94 disposed about the upper portion of spindle 60, one end of which is in contact with plate 73, and the other end of which is in contact with lower disc 90 of top bearing 86. Thus, spring 94 acts on top bearing 86, thereby urging spindle 60 towards its inoperative position.

As shown in FIG. 3, the spindles 60 and brushes 58 of second tier 46 are normally biased in a raised or inoperative position above fabric platform 14; the overall length of spindle 60 is such that when the spindle is raised, brush 58 is maintained in spaced relation with pile fabric 12 moving along platform 14 in the direction indicated by arrow 20. However, activation of multiple circuit program timer 126 selectively causes selected solenoids to be energized, thus operating valve 102 and allowing compressed air to pass from hose 106 to cylinder 99. The air pressure powers piston 98, causing connecting rod 100 to be propelled against top bearing 86 with sufficient force to overcome the action of spring 94 and cause spindle 60 to move to its lowered or operative position, shown by phantom lines in FIG. 4.

The structure of top bearing 86 previously described permits spindle 60 to rotate in response to the drive of pulley 70 while it is maintained in its lowered position by the pressure of connecting rod 100. This pressure is sufficient to move brush 58 into contact with pile fabric 12. The force with which brushes 58 make contact with fabric 12 can be varied by altering the air pressure at the source of compressed air. The upward axial movement of spindle 60, and thereby of brush 58, is limited by the travel of pin 78 within groove 76.

When continued rotation of cylinder 128 of multiple circuit program timer 126 allows arm 132 to return to its normal position, thereby causing the electrical contact to be broken, the flow of air through valve 102 is cut off, and the normal expansion of spring 94 causes spindle 60 to reciprocate to its raised or inoperative position, thus carrying brush 58 out of contact with fabric 12.

Figure 5:
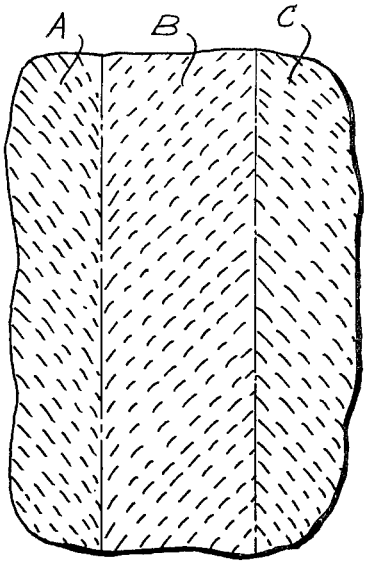
FIGS. 5, 6 and 7 illustrate the various effects which can be created on artificial fur fabric using the apparatus which is the preferred embodiment of the present invention.

Turning now to the operation of apparatus 10, artificial fur fabric 12, which may first be sprayed with a liquid, preferably a liquid resin, is transported across platform 14 beneath first tier 19 of brushes 22 and second tier 46 of brushes 58. Motors 36, 38, via drive belts 33, 35, impart constant rotational motion to spindles 24 and thereby to brushes 22. These brushes 22, being in constant contact with fabric 12, create a striped design on the surface thereof swirling the individual fibers of the fabric. FIG. 5 is a schematic representation of the appearance of fabric 12 after it has passed beneath and has been swirled by first tier 19 of brushes 22. This figure shows three stripes A, B, C, formed by three adjacent brushes 22. The pile of stripe A is swirled, for example, counterclockwise, the pile of stripe B is swirled, for example, clockwise, and the pile of stripe C is swirled, for example, counterclockwise.

Figure 6:
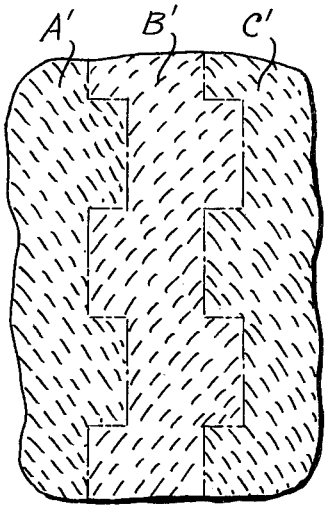

The operator of apparatus 10 can cause the striped pattern imparted to fabric 12 to appear crenelated, as depicted in FIG. 6. The first tier 19 of brushes 22 (as well as the second tier 46 of brushes 58) is carried by reciprocable frame 40. By activating electric timing means 52, the frame 40 will be driven reciprocally along track segments 44 in a direction which is transverse to that of fabric 12. This action reciprocates the brushes 22 laterally as a unit at timed intervals, causing the formation of toothed stripes A′, B′, C′ of FIG. 6.

Figure 7:
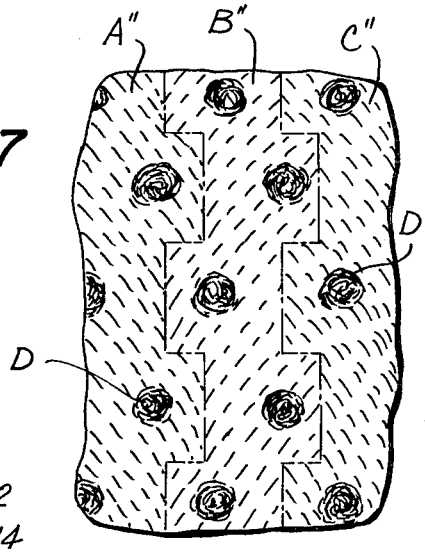

The pattern illustrated in FIG. 7 can be achieved by additional activation of multiple circuit program timer 126, causing selected brushes 58 of the second tier 46 to move into contact with the fabric 12 momentarily at desired times. The reciprocation of brushes 58 toward and away from fabric 12 causes spots D to be superimposed upon toothed stripes A″, B″, C″ of FIG. 7. The "length" of each spot D in the direction of travel of fabric 12 is dependent in part upon the speed at which fabric 12 is transported across platform 14, and in part upon the period of time during which each brush 58 of second tier 46 is maintained in its downward or operative position. The "width" of each spot D in a direction transverse to the direction of travel of fabric 12 is dependent in part upon the period of time during which each brush 58 of second tier 46 is maintained in its downward or operative position, and in part upon the speed with which frame 40 is reciprocated along track segments 44. Of course, the distribution of spots D is dependent upon which of the brushes 58 of second tier 46 are activated by the control means. The random pattern of spots D created by the second tier of brushes 46 can also be superimposed over stripes A, B, C of FIG. 5, if desired, in which case multiple circuit program timer 126 is activated but frame 40 is not reciprocated. Thereafter, the fabric 12 may be heat cured so that the pattern becomes permanent and capable of withstanding washability tests.

Although the invention has been described with reference to a particular embodiment, it is to be understood that this embodiment is merely illustrative of the application of the principles of the invention. Numerous modifications may be made therein and other arrangements may be devised without departing from the spirit and scope of the invention, as set forth in the appended claims.

What we claim is:

1. Apparatus for imparting a design to the surface of pile fabric comprising a. a fabric platform adapted to receive pile fabric traveling through said apparatus in a first direction, b. a frame adapted to move reciprocally between two positions in a second direction transverse to said first direction of movement of said traveling pile fabric, c. a first tier of rotatable brushes disposed on said frame for continuous contact with the surface of said traveling pile fabric to impart a first pattern to said traveling pile fabric, d. a second tier of rotatable brushes disposed on said frame for discontinuous contact with the surface of said traveling pile fabric to superimpose a second pattern on said traveling pile fabric, said second pattern being visually discernible from said first pattern, e. means for reciprocating said frame and the first and second tiers of rotatable brushes disposed on the frame as a unit between said two positions, f. drive means for imparting rotational motion to said first and second tiers of rotatable brushes, g. means for causing selected brushes of said second tier of rotatable brushes to engage said traveling pile fabric, and h. programming means for selective activation of said engaging means, as the pile fabric is traveling through the apparatus.

2. Apparatus in accordance with claim 1 wherein said second tier of rotatable brushes is disposed downstream of said first tier of rotatable brushes in said first direction of movement of said traveling pile fabric, and the brushes of said second tier of rotatable brushes are adapted to move between operative and inoperative positions.

3. Apparatus in accordance with claim 2 wherein said engaging means comprises means for reciprocating the brushes of said second tier of rotatable brushes between said operative position wherein said brushes are in contact with said traveling pile fabric and said inoperative position wherein said brushes are out of contact with said traveling pile fabric.

4. Apparatus in accordance with claim 3 wherein said means for reciprocating the brushes of said second tier of rotatable brushes between said two positions comprises for each brush of said second tier of rotatable brushes a. drive means for moving each said brush toward said operative position, and b. biasing means for urging each said brush toward said inoperative position.

5. Apparatus in accordance with claim 4 wherein said drive means comprises an air-driven piston slidably disposed within a cylinder and adapted for movement of each said brush toward said operative position, and valve means selectively operable by said programming means for controlling the action of said drive means.

6. Apparatus in accordance with claim 1 wherein said drive means for imparting rotational motion to said first and second tiers of rotatable brushes comprises for each said tier of rotatable brushes at least one motor and means for transmitting the movement of said one motor to one of said tiers.

7. Apparatus in accordance with claim 1 wherein said reciprocating means comprises an air-driven piston slidably disposed within a cylinder and adapted to cause reciprocal movement of said frame between said two positions, and timing means for controlling the action of said piston.

8. Apparatus in accordance with claim 1 wherein said programming means includes a multiple circuit program timer.

* * * * *